US006663276B2

(12) United States Patent
Yale

(10) Patent No.: US 6,663,276 B2
(45) Date of Patent: Dec. 16, 2003

(54) STIRRING ELEMENT AND ASSOCIATED METERING GUN

(75) Inventor: Jeffrey Lane Yale, Durham, NC (US)

(73) Assignee: SmithKline Beecham Corporation, Philadelphia, PA (US)

( * ) Notice: Subject to any disclaimer, the term of this patent is extended or adjusted under 35 U.S.C. 154(b) by 100 days.

(21) Appl. No.: 09/973,417

(22) Filed: Oct. 9, 2001

(65) Prior Publication Data

US 2002/0041537 A1 Apr. 11, 2002

Related U.S. Application Data

(60) Provisional application No. 60/239,322, filed on Oct. 10, 2000.

(51) Int. Cl.[7] ..... B01F 13/08; B01F 15/02

(52) U.S. Cl. ..... 366/192; 366/273; 366/286; 366/194; 366/195

(58) Field of Search ..... 366/192, 193, 366/273, 274, 194–196, 286; 435/302.1

(56) References Cited

U.S. PATENT DOCUMENTS 832,252 A * 10/1906 Godbe
1,081,350 A * 12/1913 Viney
2,519,707 A * 8/1950 Schaffer
2,570,078 A * 10/1951 Spremulli
3,567,402 A * 3/1971 Christensen
4,082,668 A * 4/1978 Zeineh et al.
4,266,950 A * 5/1981 Makino et al.
4,290,300 A * 9/1981 Carver
4,465,377 A * 8/1984 de Bruyne
4,534,656 A * 8/1985 de Bruyne
4,759,635 A * 7/1988 MacMichael et al.
4,830,509 A * 5/1989 Gulmatico, Jr.
5,012,845 A * 5/1991 Averette

FOREIGN PATENT DOCUMENTS

DE 199 53 887 A1 * 10/2001
FR 2 574 521 A1 * 10/1986

* cited by examiner

*Primary Examiner*—Charles E. Cooley
*Assistant Examiner*—David Sorkin
(74) *Attorney, Agent, or Firm*—James P. Riek

(57) ABSTRACT

An agitator assembly for agitating a substance in a container comprises a container, a magnetic drive device, and an agitator element. The magnetic drive device is disposed adjacent to an outside surface of a lateral wall of the container. The agitator element is disposed in the container and is magnetically coupled with the magnetic drive device for self-supported rotation about a central longitudinal axis. The agitator element includes an agitator body, a first magnet mounted at the agitator body, and a second magnet mounted at the agitator body and circumferentially spaced from the first magnet. The agitator element substantially centered about the central longitudinal axis and supported at a substantially constant axial position within the container by the magnetic drive device. A metering needle can movably and operatively extend through the agitator body, but the agitator body does not contact the needle, with the result that the agitator element and the needle are isolated and operate independently of each other.

14 Claims, 6 Drawing Sheets

STIRRING ELEMENT AND ASSOCIATED METERING GUN

This patent application is being filed in the United States Patent and Trademark office as a 37 CFR 1.53(b) application of U.S. provisional application No. 60/239,322 filed Oct. 10, 2000 in the United States Patent and Trademark office.

TECHNICAL FIELD

The present invention generally relates to the stirring of a substance in a container and the metering of quantities of such substance from the container. More specifically, the present invention relates to the design of the stirring element or agitator used to stir substances in containers.

BACKGROUND ART

Liquid metering systems are used in a wide variety of applications in the pharmaceutical industry, such as for injecting metered doses of viscous or concentrated suspensions or slurries onto or into substrates and other drug containment media. FIG. 1 illustrates an example of a recently developed liquid metering device in the form of a liquid metering gun generally designated 10. Metering gun 10 is generally supported by a mounting bracket 12. Included with this particular system are a solenoid 14, a syringe-type liquid cylinder 16, a needle valve assembly generally designated 20, and a magnetically-driven stirring assembly generally designated 50. Liquid cylinder 16 is secured and sealed to solenoid 14 with a TEFLON® cap 31. Cap 31 is attached to solenoid 14 by means of four machine screws 32 (only two of which are shown in FIG. 1). An O-ring 33 is fit into a groove of cap 31 located at the end of cap 31 most distal to solenoid 14. O-ring 33 seals cylinder 16 and maintains the dispensing pressure differential.

Needle valve assembly 20 includes an elongate pin or needle 22, a needle seat 24 and a needle seat holder 26. An outer gun casing 35 is coaxially disposed around liquid cylinder 16, and includes a lower cap 37 in which needle seat holder 26 and a nozzle 39 are disposed. A conical element 22A (also shown in perspective view in FIG. 3) is slid onto needle 22 such that it rests on the top surface of a suspension contained in cylinder 16. Conical element 22A prevents upward splashing of the suspension during agitation thereof, and also prevents evaporation of volatile media during agitation.

Stirring assembly 50 includes an external magnetic drive member or stirring ring 52 mounted coaxially around gun casing 35. Magnetic drive member 52 includes two diametrically opposed external magnets 54A and 54B, and is operatively connected to a pneumatic stirrer motor 56 through a coupling 58. Coupling 58 operates to transfer rotational force developed by stirrer motor 56 to rotational motion effected by stirring ring 52, such that external magnets 54A and 54B can rotate about the central longitudinal axis of metering gun 10. For example, coupling 58 could be a toothed gear which engages teeth on stirring ring 52. The position of motor 56 is determined by a mounting bracket 59. Stirring assembly 50 also includes a stirring element in the form of a magnetic stir bar 60, which has a dominant length along an axis transverse to the central longitudinal axis of metering gun 10. Magnetic stir bar 60 has a bore drilled therethrough, such that needle 22 extends through the center of magnetic stir bar 60 and the magnet therein. Importantly, magnetic stir bar 60 is by necessity supported by an O-ring 62.

In operation, cylinder 16 is filled with a suspension and secured to solenoid 14. Magnetic drive assembly 50 is activated such that external magnets 54A and 54B rotate around cylinder 16 and induce a magnetic coupling with magnetic stir bar 60. This in turn causes magnetic stir bar 60 to rotate about needle 22 to thereby agitate the suspension contained in cylinder 16 and prevent the suspension from separating in cylinder 16, such as by sedimentation or creaming. Needle 22 is used to meter suspension from cylinder 16. When needle 22 is seated in needle seat 24, metering gun 10 is closed. At predetermined intervals, however, solenoid 14 of metering gun 10 causes needle 22 to lift upwardly out of needle seat 24 to create a passage from cylinder 16 to nozzle 39, and a metered dose of the suspension can be dispensed through nozzle 39 under the influence of a pressure differential.

Some problems have been observed in the use of metering systems such as that described hereinabove. The configuration of stirring assembly 50 is such that O-ring 62 is needed to support the vertical position of magnetic stir bar 60 within cylinder 16 and needle 22 is needed to maintain a proper axis of rotation for magnetic stir bar 60. With repeated use of metering gun 10, O-ring 62 begins to loosen from its fixed position on needle 22 and slip downwardly towards the bottom of cylinder 16. This causes magnetic stir bar 60 to jam or seize against the inside surface of cylinder 16, thereby defeating the function of stirring assembly 50. On other occasions, either the weight of magnetic stir bar 60 on O-ring 62, the mass of magnetic stir bar 60, or the contact made between magnetic stir bar 60 and needle 22 causes downward and/or lateral forces on needle 22. Consequently, needle 22 is often deflected laterally and hence fails to seat properly onto needle seat 24 at the intended points of time, thereby causing a "constantly open" malfunction. Alternatively, the forces imparted on needle 22 can cause needle 22 to become jammed in needle seat 24 such that the valve becomes clogged. These failure events have been observed to occur both sporadically and completely, and are believed to be due at least in part to the rocking of magnetic stir bar 60 back and forth at an angle to needle 22. In addition, the rapid vertical oscillation of needle 22 during high-frequency metering operations imparts a hammering effect on magnetic stir bar 60, causing stir bar 60 to move O-ring 62 downwardly.

An additional problem stems from the fact that a bore is drilled through magnetic stir bar 60 to enable needle 22 to pass therethrough. The drilling of the bore can produce residual ferromagnetic particles which, due to magnetic attraction, are difficult to identify and eliminate from the bore prior to installation of magnetic stir bar 60 in cylinder 16. These particles can contaminate the suspension, and additionally can cause seizing of stir bar 60 on needle 22.

The configuration of magnetic stir bar 60 is also believed to engender a further problem observed wherein portions of the suspension splash upwardly to regions of cylinder 16 from which the suspension cannot easily be extracted, especially when the height of the suspension falls down to or below the level at which stir bar 60 is operating.

It is also believed that the configuration of the stirring element could be improved over the current stir bar design in order to improve the ability to stir suspensions having broader concentration, viscosity and thickness ranges.

The present invention is provided to solve these and other problems associated with the operations of liquid metering systems.

DISCLOSURE OF THE INVENTION

According to one embodiment of the present invention, an agitator assembly for agitating a substance in a container comprises a container, a magnetic drive device, and an agitator element. The container has a central longitudinal axis and includes a lateral wall defining an inside wall surface and an outside wall surface. The magnetic drive device is disposed adjacent to the outside wall surface of the lateral wall. The agitator element is disposed in the container and is magnetically coupled with the magnetic drive device for self-supported rotation about the central longitudinal axis. The agitator element includes an agitator body, a first magnet mounted at the agitator body, and a second magnet mounted at the agitator body and circumferentially spaced from the first magnet. The agitator element substantially centered about the central longitudinal axis and supported at a substantially constant axial position within the container by the magnetic drive device.

According to another embodiment of the present invention, a fluid metering device comprises a container, an elongate valve member, and an agitator assembly including a drive device and a movable agitator element. The container has a longitudinal axis and includes a lateral wall and an outlet aperture. The elongate valve member extends into the container, and is movable substantially along the longitudinal axis to alternately open and close the outlet aperture. The agitator element includes surfaces adapted to agitate a substance contained in the container. The agitator element is disposed in the container in non-contacting relation with the valve member, and is supported at a substantially constant axial position within the container at a distance from the outlet aperture.

The present invention further provides a method for agitating a substance in a container. In the method, a container is filled with a substance such as a viscous or a concentrated suspension. A magnetic drive device is mounted at a position adjacent to a lateral wall of the container. An agitator element is constructed by forming an agitator body, mounting a first magnet to the agitator body, and mounting a second magnet to the agitator body in circumferentially spaced relation to the first magnet. The agitator element is then immersed in the substance. The agitator element is caused to maintain a vertically suspended position along a length of the container by establishing a magnetic couple between the magnetic drive device and the agitator element. The agitator element is caused to rotate about a central longitudinal axis of the container, while remaining substantially centered along the longitudinal axis, by rotating the magnetic drive device around the container.

It is therefore an object of the present invention to provide a stirring element which is self-supporting at a relatively constant vertical position within a liquid cylinder or other container without the need to make physical contact with additional support structure within such cylinder.

It is another object of the present invention to provide a stirring element which does not jam or seize against the cylinder or against a metering needle or other valve component provided with the cylinder.

It is a yet another object of the present invention to provide a stirring element which rotates around a central longitudinal axis of the cylinder in a substantially constant radial position with respect to such longitudinal axis, and which does not rely on the presence of a metering needle to maintain such position.

It is a further object of the present invention to provide a stirring element which does not impair and affect the oscillatory and seating operations of a metering needle or other valve component provided with the cylinder.

It is a still further object of the present invention to provide a stirring element which permits a higher stirring rate without shearing the magnetic couple produced between the stirring element and an external magnetic drive device driving the stirring element.

Some of the objects of the invention having been stated hereinabove, other objects will become evident as the description proceeds when taken in connection with the accompanying drawings as best described hereinbelow.

DETAILED DESCRIPTION OF THE INVENTION

Figure 1:
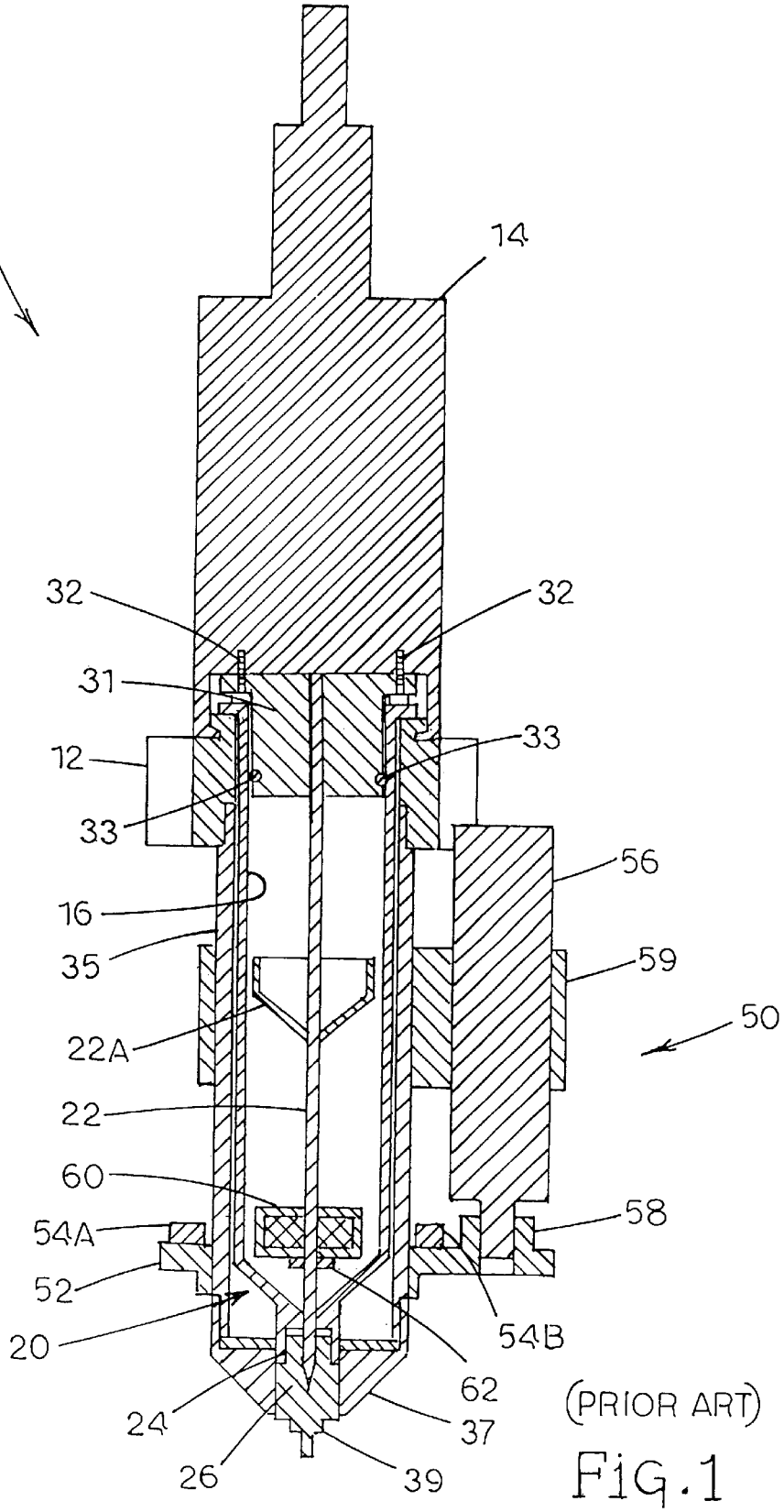
(PRIOR ART) FIG. 1
FIG. 1 is a view of a liquid metering device known to applicants.
Figure 2:
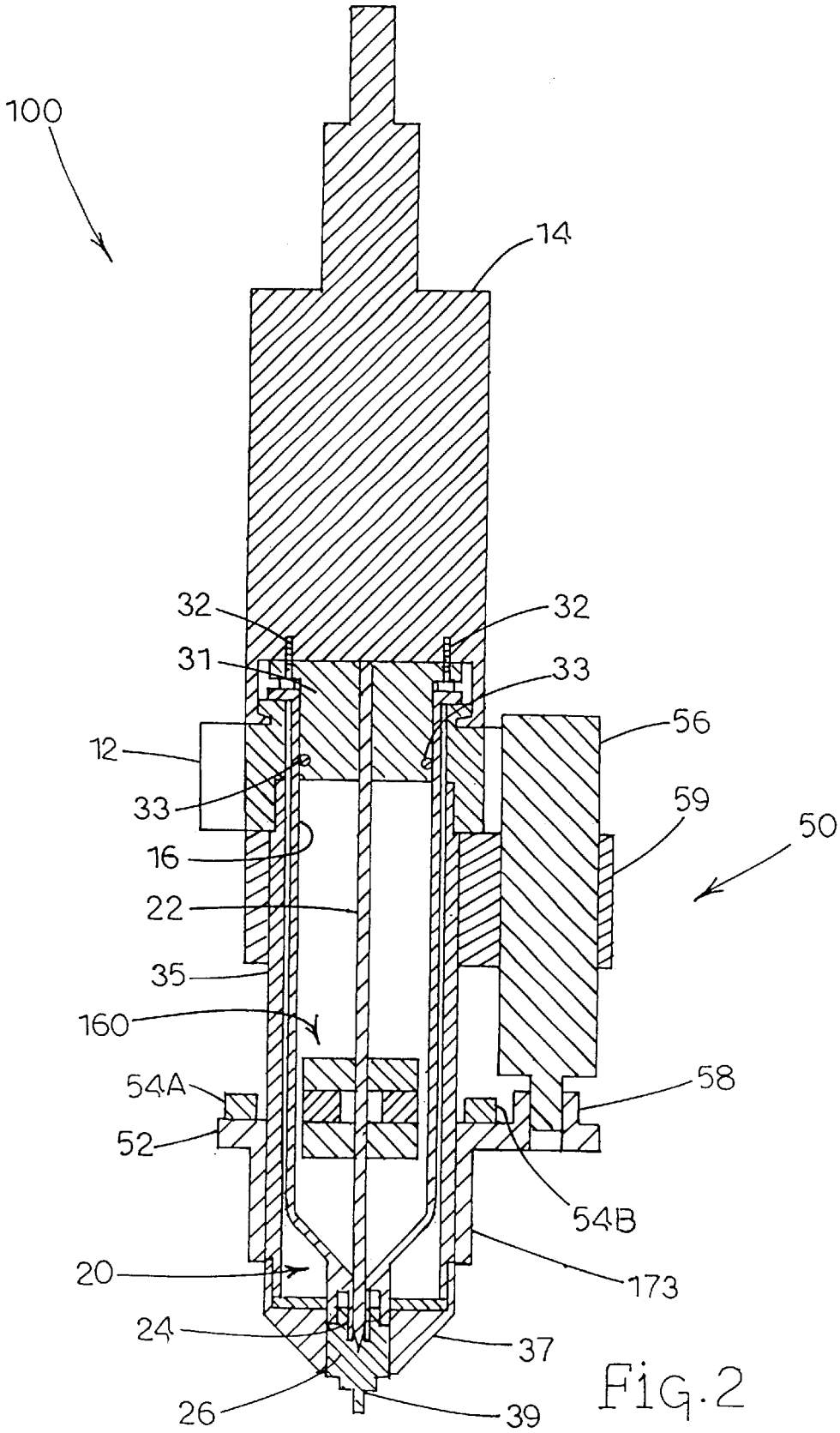
FIG. 2 is a vertical cross-sectional view of a liquid metering device provided in accordance with the present invention.
Figure 3:
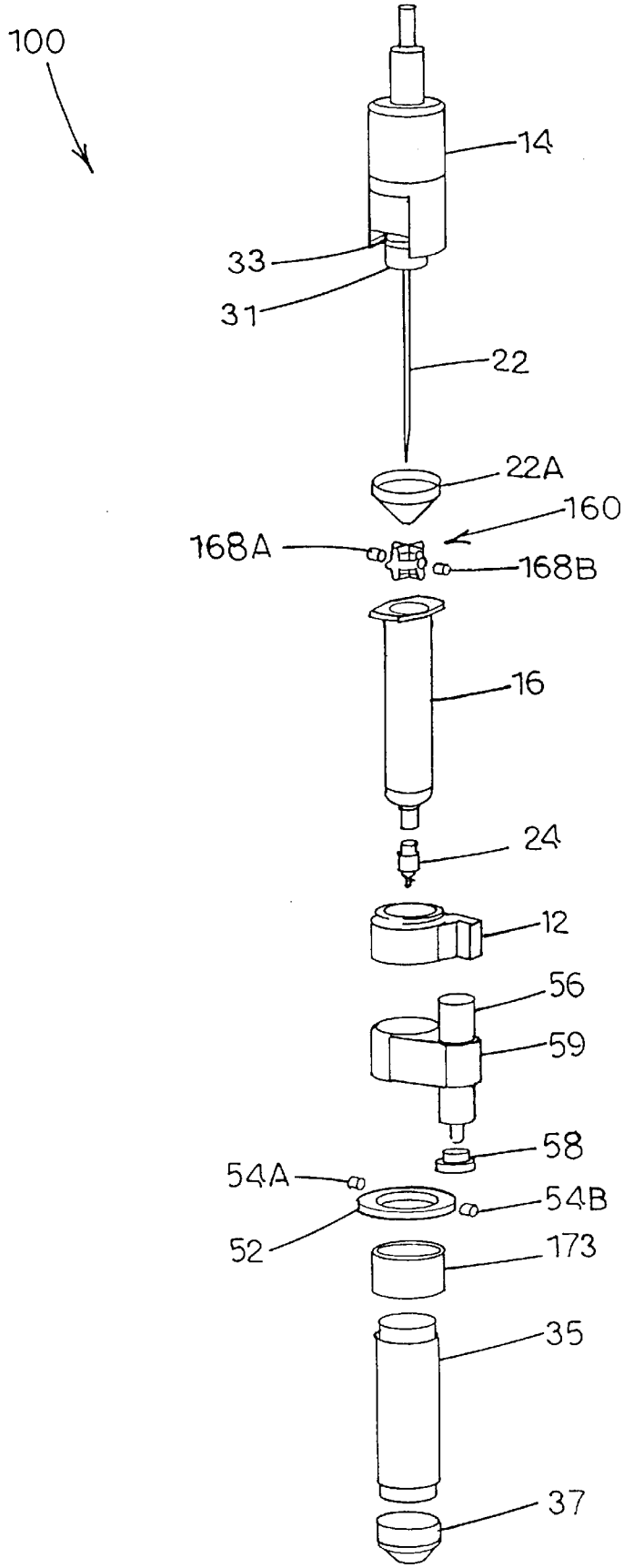
FIG. 3 is an exploded view of the liquid metering device of FIG. 2.

Referring to FIGS. 2 and 3, an improved liquid metering device generally designated 100 is provided in accordance with the present invention. In comparing improved metering device 100 to previously-described metering gun 10 of FIG. 1, it is seen that many of the components remain essentially unchanged or unmodified. These components are thus designated with the same reference numerals. The primary difference relates to an improved drum-shaped stirring or agitator element generally designated 160. Stirring element 160 is adapted to operate in conjunction with needle valve assembly 20 and stirring assembly 50, as shown in FIGS. 1 and 3.

Figure 4A:
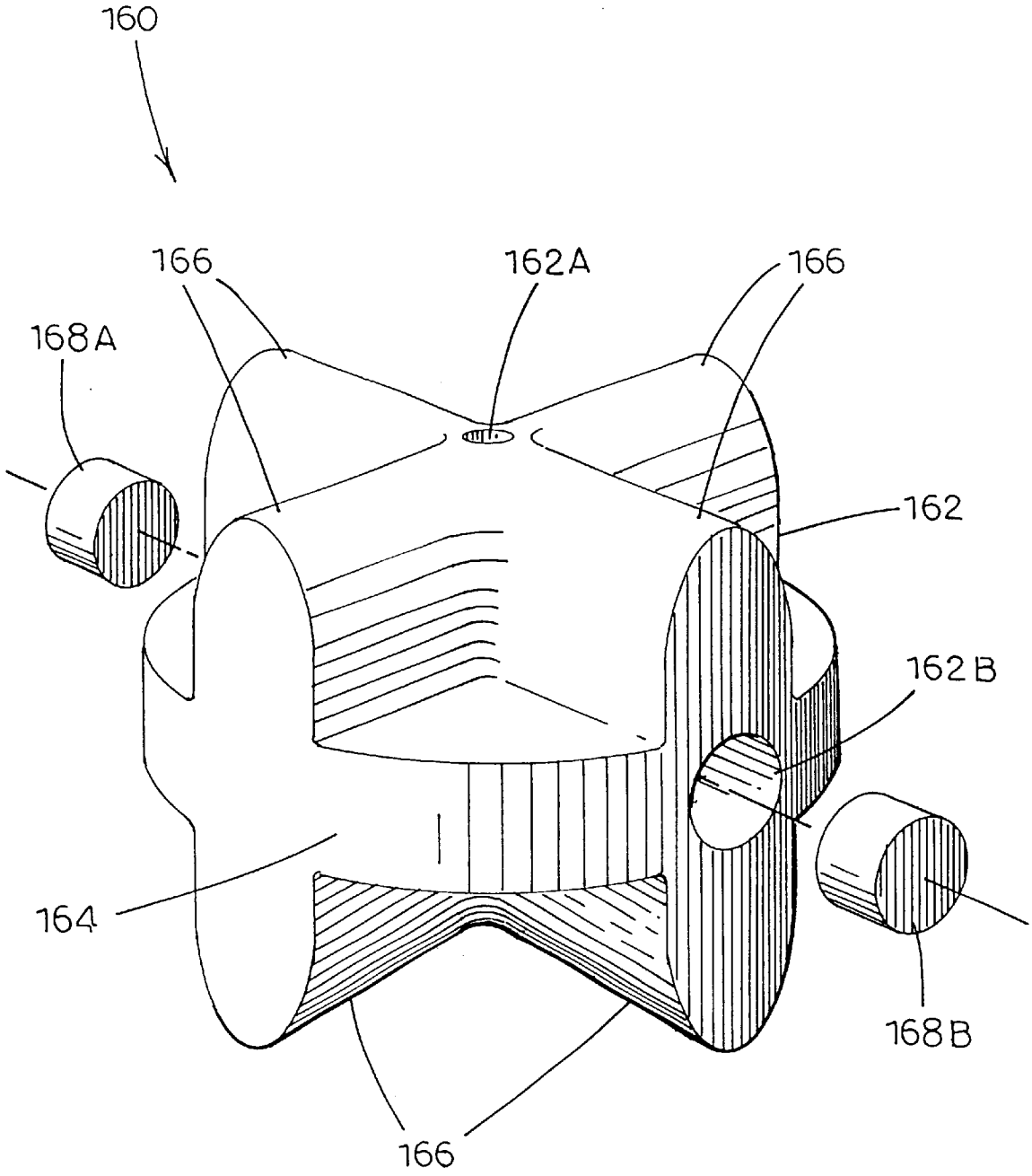
FIG. 4A is a perspective view of a stirring element according to the present invention.
Figure 4C:
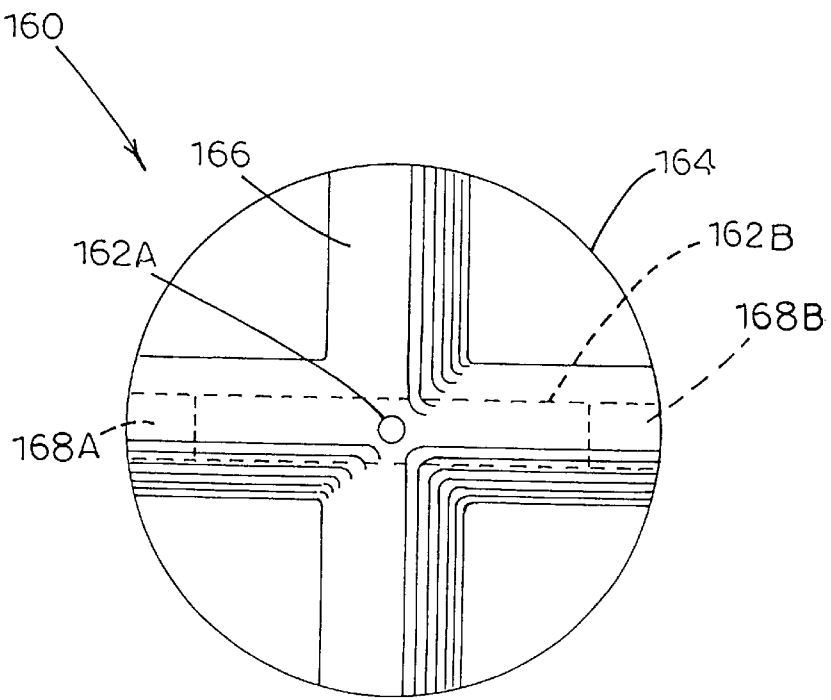
FIG. 4C is a top plan view of the stirring element of FIG. 4A.
Figure 4B:
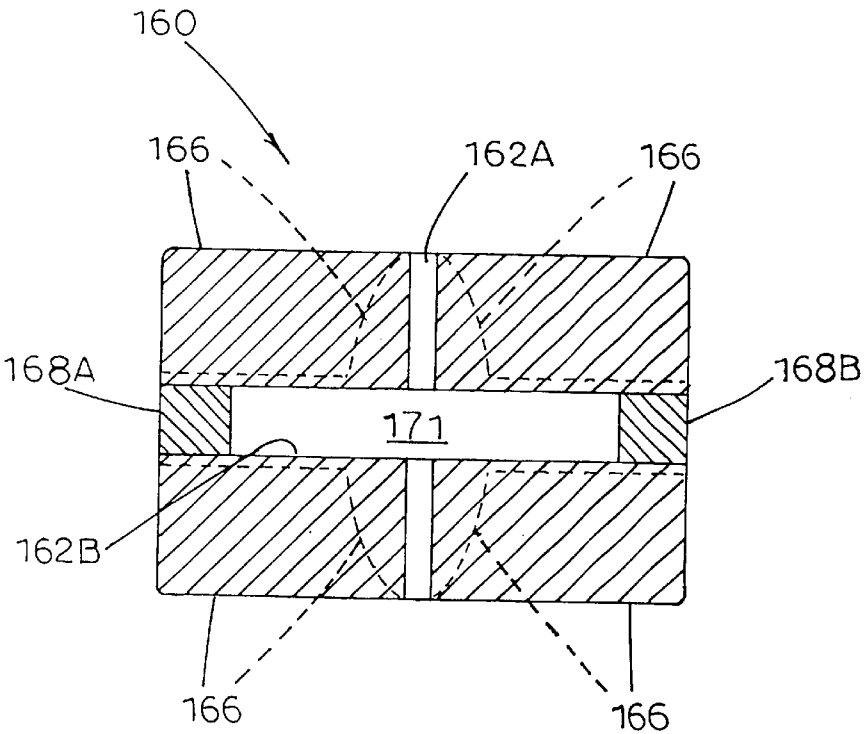
FIG. 4B is a partially cutaway side elevation view of the stirring element of FIG. 4A.

The details of stirring element 160 are best shown in FIGS. 4A, 4B and 4C. Stirring element 160 can be fabricated by modifying, in accordance with the present invention, a stir drum available from VWR International, Plainfield, N.J., and designated as Part No. 58949-004. Stirring element 160 includes an agitator body 162 preferably constructed from a light-weight polymeric material. Agitator body 162 includes a centrally disposed disk-shaped portion 164, such that the cross-section of stirring element 160 is circular rather than rectilinear as in the case of above-described magnetic stir bar 60. In order to improve the agitating capability of stirring element 160, vanes or fins 166 are formed above and below central portion 164 of agitator body 162. An enlarged axial through-bore 162A is drilled through the center of agitator body 162 to enable needle 22 to pass through agitator body 162 while maintaining an annular gap between needle 22 and agitator body 162.

Agitator body 162 also includes a radial through-bore 162B drilled through central portion 164. While radial through-bore 162B could receive a solid cylindrical magnet as in the case of magnetic stir bar 60, it was discovered to be much more advantageous to mount two separate, diametrically opposed internal magnets 168A and 168B at the outer ends of radial through-bore 162B. In this manner, there is no need to drill a bore through the magnetic portion of stirring element 160 and hence there are no residual magnetic particles which could contaminate the suspension. In addition, the portion of radial through-bore 162B between internal magnets 168A and 168B cooperates with axial through-bore 162A to define an interior 171 of agitator body 162 that is open to cylinder 16 through the ends of axial through-bore 162A. Preferably, internal magnets 168A and 168B are constructed from a rare earth material.

Metering device 100 is assembled as shown in FIGS. 2 and 3. A magnetic drive member is again provided in the form of stirring ring 52 on which external magnets 54A and 54B are mounted, and a shim 173 coaxially disposed around outer gun casing 35 can be used to elevate the position of stirring ring 52 relative to the height of cylinder 16.

In the operation of metering device 100, it was found to be an unexpected and surprising result that stirring element 160 designed according to the present invention spun along the central longitudinal axis of metering device 100 in a completely self-supporting or self-suspending manner. That is, stirring element 160 is structurally isolated from needle 22 and does not require O-ring 62 shown in FIG. 1. The magnetic coupling produced between external magnets 54A and 54B of stirring ring 52 and internal magnets 168A and 168B of stirring element 160 is sufficient to maintain the vertical position of stirring element 160 with respect to cylinder 16. The improved magnetic force is due at least in part to the use of two internal magnets 168A and 168B instead of a single magnet. Even when stirring element 160 is immersed in a highly viscous or concentrated suspension, stirring element 160 rotates about the central longitudinal axis with little or no rocking or wobbling. Stirring ring 52 thus operates to both rotate stirring element 160 and maintain its vertical position within cylinder 16. It is also believed that, upon immersion in the suspension, interior 171 of agitator body 162 fills with suspension material and that the stirring motion of stirring element 160 imparts a flushing action in agitator body interior 171 to prevent the suspension material from causing seizing of stirring element 160 on needle 22.

In addition to the elimination of seizing problems, the performance of needle 22 is greatly improved. The physical isolation of stirring element 160 from needle 22 prevents any contact that might interfere with the proper seating of needle 22 during its operation. This isolation also removes the weight of stirring element 160 from needle 22, thereby permitting the acceleration/deceleration profiles that control solenoid 14 to operate as originally intended. This is an improvement over the use of magnetic stir bar 60 in FIG. 1, whose contact with needle 22 is believed to cause dragging forces which alter the acceleration/deceleration profiles by decreasing both acceleration and deceleration.

Not only is the magnetic coupling between stirring ring 52 and stirring element 160 of sufficient magnitude to magnetically suspend stirring element 160 during the entire dispensing process, but the magnetic force produced is also strong enough to allow much higher stirring rates than heretofore possible without causing a shearing or breaking down of the magnetic coupling. In addition, a broader range of suspensions, whether concentrated, unconcentrated, viscous or diluted, can now be stirred at a higher rate.

Furthermore, the large cross-sectional profile presented by central portion 164 of agitator body 162, and the vertical orientation of fins 166, may assist in preventing upward splashing of the suspension and evaporation of volatile media during agitation. Consequently, conical element 22A shown in FIGS. 1 and 3 may not be needed in the present invention.

Figure 2A:
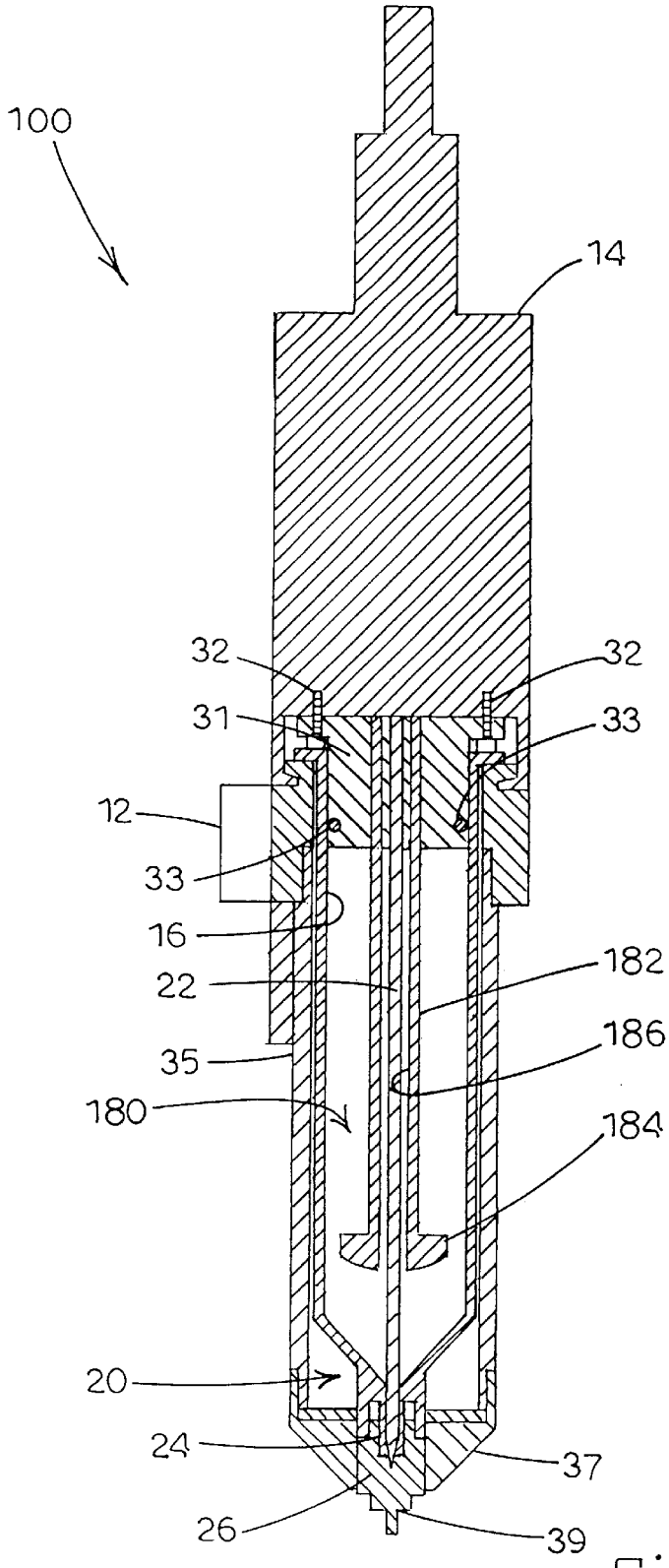
FIG. 2A is a vertical cross-sectional view of an alternative liquid metering device provided in accordance with the present invention.

Referring to FIG. 2A, an alternative embodiment is provided wherein a paddle-type stirring element generally designated 180 is installed in cylinder 16 of metering device 100 in a case where a positively driven agitator element might be found to be more suitable than magnetically driven stirring element 160. Paddle-type stirring element 180 is an assembly which includes a shaft 182 extending into cylinder 16 from the upper portion of metering device 100 containing solenoid 14. A stirring element in the form of a paddle 184, such as a blade-type paddle, is attached to the end of shaft 182. Shaft 182 is coupled to a conventional rotational drive device such as a motor and gear assembly (not shown) located in the upper portion of metering device 100. Although paddle-type stirring element 180 could be disposed in an offset relation to the central longitudinal axis of cylinder 16, it is more preferable that shaft 182 and paddle 184 both be provided as hollow components, such that shaft 182 and paddle 184 are centralized within cylinder 16 and needle 22 extends through shaft 182 and beyond the tip of paddle 184. An annular gap 186 is thus defined between paddle-type stirring element 180 and needle 22. In this manner, paddle-type stirring element 180 performs agitation operations within cylinder 16 without interfering with the operation of needle 22 and does not require structural support from needle 22.

In a case where cylinder 16 is of significant length for holding a larger quantity of media, a plurality of agitator bodies 162 or paddles 184 can be vertically spaced along the length of cylinder 16. Where magnetically driven stirring element 160 is employed, this alternative also requires the use of a plurality of corresponding stirring rings 52 to drive each stirring element 160.

In other cases, it may also be desirable that metering device 100 have the capability of varying the vertical position of agitator body 162 or paddle 184 as the level of media within cylinder 16 changes. Thus, a suitable motor and gear drive or structure requiring manual adjustment (not shown) could be provided to adjust the height of stirring assembly 50 or shaft 182.

It therefore can be seen that the present invention provides a magnetically driven or paddle-type stirring element which is self-supporting at a relatively constant vertical position within a liquid cylinder or other container without the need to make physical contact with additional support structure within such cylinder, such as an O-ring or metering needle. It can also be seen that the stirring element does not jam or seize against the cylinder or against the metering needle, and rotates around the central longitudinal axis of the cylinder in a substantially constant radial position with respect to such longitudinal axis. Because the stirring element does not depend on the needle for structural support, it does not impair the successful operation of the needle within the cylinder. In addition, the configuration of the stirring element results in an improved agitation effect and permits increased stirring rates.

It will be understood that magnetic stirring element 160 provided by the present invention is not limited to use in connection with any specific metering or stirring device.

It will be further understood that various details of the invention may be changed without departing from the scope of the invention. Furthermore, the foregoing description is for the purpose of illustration only, and not for the purpose of limitation—the invention being defined by the claims.

What is claimed is:

1. A fluid metering device comprising:

(a) a container having a longitudinal axis and including a lateral wall defining an inside wall surface and an outside wall surface and an outlet aperture;

(b) an elongate valve member extending into the container and movable substantially along the longitudinal axis to alternately open and close the outlet aperture; and (c) an agitator assembly including a drive device and a movable agitator element, the agitator element including surfaces adapted to agitate a substance contained in the container, wherein the agitator is disposed in the container in non-contacting relationship with the valve member and is supported at a substantially constant axial position within the container at a distance from the outlet aperture;

wherein the drive device is a magnetic drive device disposed adjacent to the outside wall surface of the lateral wall and the agitator element is supported solely by being magnetically coupled with the magnetic drive device for rotation about the longitudinal axis.

2. The fluid metering device according to claim 1 wherein the agitator element includes an agitator body having an axial through-bore, the valve member extends through the axial through-bore, the agitator element is substantially centered about the longitudinal axis, and the agitator element is supported at the substantially constant axial position within the container by the magnetic drive device.

3. The fluid metering device according to claim 2 wherein the agitator element includes a first magnet radially spaced from the axial through-bore and a second magnet radially spaced from the axial through-bore in circumferentially spaced relation with the first magnet.

4. The fluid metering device according to claim 3 wherein the agitator element includes a central portion and the first and second magnets are each mounted at the central portion.

5. The fluid metering device according to claim 3 wherein the first and second magnets are constructed from a rare earth material.

6. The fluid metering device according to claim 2 wherein the valve member and the axial through-bore of the agitator body cooperatively define an annular gap.

7. The fluid metering device according to claim 1 wherein the agitator element includes a central portion having first and second surfaces, the first and second surfaces disposed transversely with respect to the longitudinal axis.

8. The fluid metering device according to claim 7 wherein the agitator element includes a first agitation vane extending axially from the first surface of the central portion and a second agitation vane extending axially from the second surface of the central portion.

9. The fluid metering device according to claim 1 wherein the agitator element has an interior region in open communication with the container.

10. The fluid metering device according to claim 9 wherein the agitator clement includes an agitator body having an axial through-bore, the axial through-bore is in open communication with the container, and the interior region is in open communication with the axial through-bore.

11. The fluid metering device according to claim 1 wherein the agitator element includes an agitator body having an outside lateral surface, an axial through-bore and a radial through-bore in open communication with the axial through-bore, the radial through-bore extending between a first location on the agitator body lateral surface and a second location on the agitator body lateral surface diametrically opposed to the first location.

12. The fluid metering device according to claim 11 comprising a first magnet mounted in the radial through-bore proximate to the first location and a second magnet mounted in the radial through-bore proximate to the second location.

13. The fluid metering device according to claim 1 wherein the agitator assembly includes a plurality of agitator elements vertically spaced in relation to a length of the container, wherein each agitator element is disposed in the container in non-contacting relation with the valve member and is supported at a substantially constant axial position within the container at a respective distance from the outlet aperture.

14. The fluid metering device according to claim 1 comprising a motor and gear drive assembly for adjusting a vertical position of the agitator element with respect to a length of the container.

* * * * *